US005153479A

United States Patent [19]

Chakrabarti et al.

[11] Patent Number: 5,153,479

[45] Date of Patent: Oct. 6, 1992

[54] MINIATURE LOW-WATTAGE NEON LIGHT SOURCE

[75] Inventors: Kirti B. Chakrabarti, Lynnfield; Robert E. Levin, Hamilton, both of Mass.

[73] Assignee: GTE Products Corporation, Danvers, Mass.

[21] Appl. No.: 698,882

[22] Filed: May 13, 1991

[51] Int. Cl.[5] ..... H01J 61/42; H01J 61/34; H01J 61/35

[52] U.S. Cl. ..... 313/25; 313/493; 313/572; 313/610; 313/612; 313/634; 313/637

[58] Field of Search ..... 313/25, 493, 634, 572, 313/573, 576, 609, 610, 611, 612, 637, 638, 642, 643

[56] References Cited

U.S. PATENT DOCUMENTS

| | | | |
|---|---|---|---|
| 2,123,709 | 7/1938 | Bristow et al. | 313/610 |
| 2,152,999 | 4/1939 | Milner | 313/25 X |
| 2,874,324 | 2/1959 | Klepp et al. | 313/572 |
| 2,976,451 | 3/1961 | Reiling et al. | 313/171 |
| 3,449,615 | 6/1969 | Tucker et al. | 313/572 |
| 3,651,366 | 3/1972 | Gianni | 313/573 |
| 3,778,662 | 12/1973 | Johnson | 313/490 |
| 3,947,719 | 3/1976 | Ott | 313/489 |
| 4,039,889 | 8/1977 | Vicai | 313/573 X |
| 4,196,374 | 4/1980 | Witting | 313/204 X |
| 4,199,701 | 4/1980 | Bhattaharya | 313/572 X |
| 4,441,045 | 4/1984 | Sprengers | 313/638 X |
| 4,622,485 | 11/1985 | Miyashita et al. | 313/572 X |
| 4,710,679 | 12/1987 | Budinger et al. | 315/58 |
| 4,847,530 | 7/1989 | English et al. | 313/25 |
| 4,864,180 | 9/1989 | English et al. | 313/44 |
| 4,945,288 | 7/1990 | Morris et al. | 313/25 |

FOREIGN PATENT DOCUMENTS

| | | | |
|---|---|---|---|
| 0187855 | 11/1982 | Japan | 313/493 |
| 0037646 | 2/1985 | Japan | 313/572 |
| 2067826 | 7/1981 | United Kingdom | 313/573 |

*Primary Examiner*—Donald J. Yusko
*Assistant Examiner*—Ashok Patel
*Attorney, Agent, or Firm*—Carlo S. Bessone

[57] ABSTRACT

A source of red light includes a double-bore capillary tube having a pair of ends and a convoluted shape. A pair of electrodes is located at one end of the capillary tube and disposed within respective bores. An ionizable medium is enclosed within the capillary tube and includes neon at a pressure from about 300 to 600 torr. When energized, the ionizable medium generates an arc discharge between the electrodes consisting primarily of radiation in the range of from 590 to 670 nanometers. An outer jacket of vitreous material may surround the capillary tube and contain an inert gas (e.g., nitrogen) at a predetermined pressure.

2 Claims, 3 Drawing Sheets

MINIATURE LOW-WATTAGE NEON LIGHT SOURCE

GOVERNMENT INTEREST IN INVENTION

The Government has rights in this invention pursuant to Contract No. DTCG23-87-C-20026 awarded by the United States Coast Guard.

CROSS-REFERENCE TO A RELATED APPLICATION

This application discloses, but does not claim, inventions which are claimed in U.S. Ser. Nos. 07/698,883 filed concurrently herewith and assigned to the Assignee of this application.

FIELD OF THE INVENTION

This invention relates in general to arc discharge lamps and pertains, more particularly, to a miniature, low-wattage light source suitable for use in navigational signal lighting, such as a lighted buoy, wherein a red light is desired. Lighted buoys employ flashing lights and are used to mark navigable channels and wrecks, shallows, or other hazards. The reliability of lamps used in navigational signal lighting is an important factor because servicing is often carried out on an annual basis.

BACKGROUND OF THE INVENTION

Tungsten filament lamps have been heavily relied on in the past for navigational signal lighting. In order to produce red light, the tungsten filament lamp may be surrounded by a red-colored filter or the lamp envelope may be colored with a red dye. Besides having low efficiencies, the filament in such lamps is very brittle and therefore susceptible to shock and vibration. This results in premature lamp failure. Also, in general, they have short life of about 500 hours.

Modern light sources, more particularly arc discharge sources, have been or are being developed for navigational signal lighting applications because of the many advantages offered by these light sources. It is well known that an arc discharge source generally provides better efficacy and longer life than its tungsten filament lamp counterpart. Since the electrodes are heavier than the filament, the lamp may be more rugged and less susceptible to shock and vibration.

In an arc discharge lamp, the length and width of the arc are design variables to a large extent. In an tungsten filament lamp, the length and width of the filament are for the most part determined by the lamp wattage. Thus, there is greater flexibility in the choice of optical characteristics of the light source with arc discharge lamps than with comparable tungsten filament lamps.

The principal object of a navigational signal light is to emit as much light flux as possible from a reliable light source and direct the light into the plane of the horizon. The light may be collected into one or more narrow beams which are mechanically rotated, or it may be radiated in all horizontal directions simultaneously. There are basically two types of rotating beams or beacons. In the first type, a reflector or other means of concentrating the light is used with the lamp. The entire optical system is rotated. This method generally produces a single beam; all of the emitted light is swept through 360 degrees. For an example of this first type of beacon and an arc discharge lamp for use therewith, see U.S. Pat. No. 4,847,530 which issued to English et al and which is assigned to the same Assignee as the present application. This patent describes an arc discharge lamp which, in one specific example, is rated at 175 watts.

In the second type, a rotating screen surrounds a stationary lamp. The screen contains multiple lenses or other means for concentrating light. The rotating screen generally produces multiple rotating beams, one beam associated with each lens or sector subtended by a lens. The emitted light within any sector is formed into a pencil beam and swept only within that sector. It is this type of beacon and, more particularly, the light source associated therewith, which is the subject of this disclosure.

For an example of this second type of beacon and an arc discharge lamp for use therewith, see U.S. Pat. No. 4,864,180 which issued to English et al and which is assigned to the same Assignee as the present application. This patent describes a metal-halide arc discharge lamp which, in one specific example, is rated at 45 watts.

The arc discharge lamps in the above-described patents are quite suitable for various navigational lighting applications wherein a "white" light is desired. Even if these lamps are used with red-colored filters, they would still have the disadvantage of generating too much heat if enclosed within the relatively small beacon enclosure of a typical lighted buoy. Further, the percentage of the visible spectrum that is red is less for conventional white arc discharge lamps than for incandescent lamps.

Other sources of red light other than the examples discussed above are also available. For example, fluorescent lamps which emit radiation primarily in the red region of the spectrum are well known in the art. U.S. Pat. No. 3,365,232, which issued to Repsher on Jan. 23, 1968, discloses a fluorescent lamp having a phosphor coating which emits mainly in the red region of the spectrum in response to ultraviolet radiation in combination with an underlying layer of red pigment that filters out all of the visible radiation below a certain wavelength (e.g., 600 nanometers). Although this lamp is effective in producing a red component of light, the red is not saturated. The light form such a fluorescent lamp tends toward pink due to the presence of violet, blue, green, and yellow lines of mercury radiation from the arc itself. A saturated red can be produced by adding filters to the source, but this can cause a considerable loss of efficiency.

Another source of red light is conventional low pressure, neon arc discharge lamps. This light source, which consists of long tubes and is generally used for advertising signs, is filled with pure neon at a relatively low pressure. The form of the tube is seldom straight and is usually tailor-made to the customer's wishes. Although the neon sign is also effective in producing a reddish light, the light is more orange than red. Filtering to remove the shorter wavelengths is required to meet specifications for signal red, and this reduces efficiency. Due to the low pressure filling of the lamps (on the order of 10 torr), they are relatively large in size to achieve good life, efficiency, and maintenance. More important, the light radiated per unit area of tube wall is low. The large source size necessary to produce the required light and the low radiation density are the converse of properties required for the optics of navigational beacons and similar devices.

It would be an advancement of the art if a light source could be provided which is suitable for use in a navigational signal light, such as a lighted buoy.

SUMMARY OF THE INVENTION

It is, therefore, an object of the present invention to obviate the disadvantages of the prior art.

It is still another object of the invention to provide a light source suitable for use in a navigational signal light, such as a lighted buoy, wherein a red light is desired.

It is another object of the invention to provide a light source having a relatively high efficiency.

It is still another object of the invention to provide a light source having a relatively long life.

These objects are accomplished in one aspect of the invention by the provision of a light source comprising a double-bore capillary tube having a pair of ends and a convoluted shape. The capillary tube is capable of transmitting visible radiation. A pair of electrodes is located at one end of the capillary tube and disposed within respective bores. An ionizable medium is enclosed within the capillary tube and includes neon at a pressure of from 300 to 600 torr. In one embodiment of the invention, an outer jacket of vitreous material surrounds the capillary tube. The light source may further include a base secured to one end.

In accordance with further aspects of the present invention, the inner capillary tube includes a single U-shaped portion and a pair of legs. The legs are in a contiguous relationship or separated a distance not more than 0.010 inch. In another embodiment, the inner capillary tube includes a pair of U-shaped portions with each of the U-shaped portions having a pair of legs associated therewith. The legs of each pair of legs are in a contiguous relationship or closely adjacent with each other.

In accordance with further teachings of the present invention, the wattage of the lamp is from 0.5 watt to about 6 watts. In a preferred embodiment, the inner capillary tube has an outer diameter of approximately 4 millimeters and the outer jacket has an outer diameter of approximately 12.7 millimeters (0.5 inch). In a preferred embodiment, the inner capillary tube contains neon at a pressure of approximately 525 torr.

In accordance with still further aspects of the present invention, the pressure of the ionizable medium within the capillary tube is within the range of from 300 to 600 torr. Preferably, the outer jacket contains an inert gas such as nitrogen at a pressure of about 300 torr.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
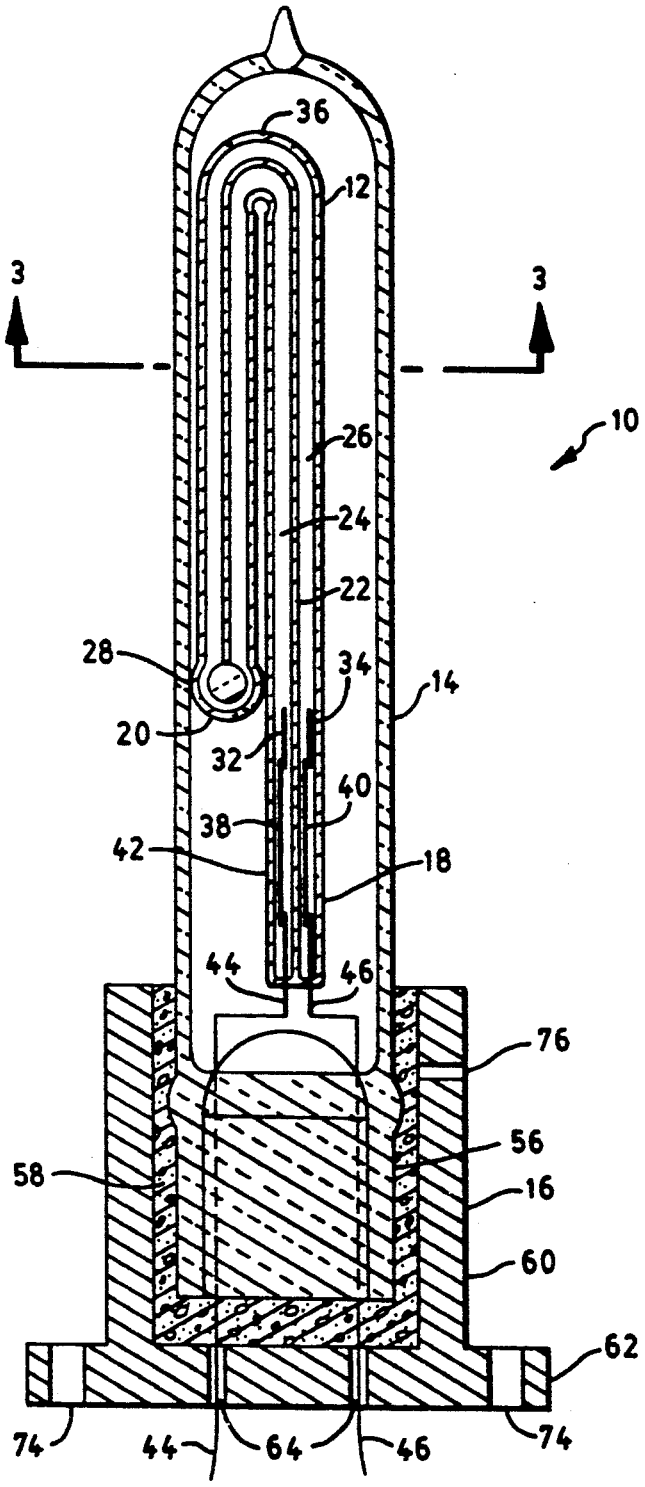
FIG. 1 represents a cross-sectional side elevation view a light source in accordance with one embodiment of the present invention.
Figure 2:
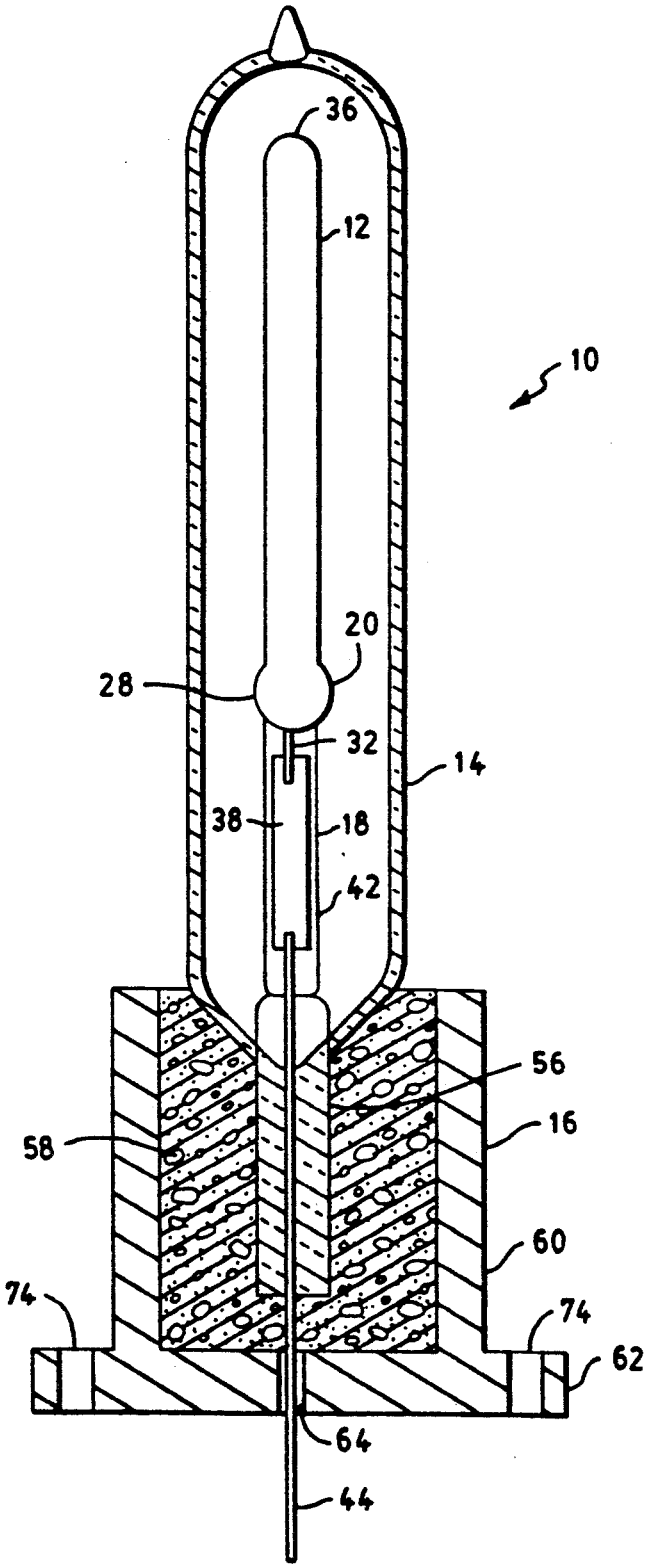
FIG. 2 is a partial cross-sectional side elevation view of the light .source in FIG. 1 rotated 90 degrees.

Referring to the drawings and to FIGS. 1 and 2 in particular, shown therein and generally designated by the reference character 10 is a light source constructed in accordance with one embodiment of the invention. As shown therein, light source 10 includes a generally convoluted capillary tube 12 which may be sealed within an outer jacket 14. If desired, a base 16 may also be secured to one end of the outer jacket of the lamp. The lamp is preferably miniature in size having, for example, a diameter of 0.5 inch (12.7 millimeters) and a maximum length of 3.0 inches (7.62 centimeters). The lamp wattage is typically within the range of from 0.5 watt to about 6.0 watts.

In the embodiment of the invention as best shown in FIG. 1, capillary tube 12 is formed with a single U-shaped portion 36. Preferably, the legs of the U-shaped tube 12 are either in a contiguous relationship with each other or closely adjacent with a separation distance of less than 0.010 inch.

Figure 3:
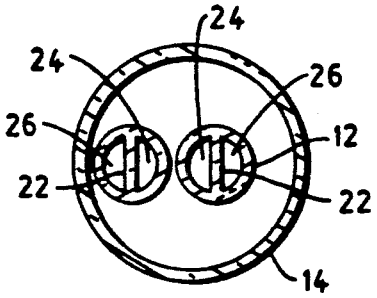
FIG. 3 is a cross-sectional view of the light source in FIG. 1 taken along the line 3—3.

Capillary tube 12, which may consist of quartz glass, includes an internal separator 22 which divides the internal cavity of the tube into a pair of bores 24, 26. As best shown in FIG. 1, separator 22 extends from end 18 of capillary tube 12 to an opposite end 20. An area 28 at opposite end 20 provides an arc joining region. As depicted in FIG. 3, each bore 24, 26 may have a semi-circular cross-section.

A pair of electrodes 32 and 34 is disposed within end 18 of capillary tube 12. As illustrated in FIG. 1, electrode 32 protrudes within bore 24 and electrode 34 protrudes within bore 26. In a preferred embodiment, electrodes 32 and 34 are constructed from tungsten rods. Metal foils 38, 40 formed of, for example, molybdenum are buried apart from each other within a common vacuum seal 42. Metal foils 38, 40 are respectively connected to outer lead wires 44, 46 extending to the outside.

An ionizable medium which consists of 100 percent neon is enclosed within capillary tube 12. Preferably, the neon is an ultra pure research quality grade. In accordance with the teachings of the present invention, the pressure of the neon fill should be within a range from about 300 to 600 torr in order to provide easy starting, long life and a well defined light output spectrum. When energized, the ionizable medium generates an arc discharge comprising red-orange radiation primarily in the range of from about 590 to 670 nanometers.

The convoluted double-bore construction of the capillary tube allows an elongated arc length to be contained within a compact space. For example, in the embodiment depicted in FIGS. 1 and 2, if the distance between the tip of one of the electrodes to the top of the U-shaped portion 36 is 1.5 inches (3.81 centimeters), the arc length will be approximately 6.0 inches (15.24 centimeters).

The lamp of the present invention may be constructed with an outer jacket 14. Outer jacket 14 is formed of vitreous material having a low coefficient of absorption in the visible spectrum. One suitable type of glass is borosilicate with lead available from Corning Glass Works as type 7720 under the tradename Nonex. Outer jacket 14 surrounds capillary tube 12 and is sealed by means of a pinch seal 56.

The volume between outer jacket 14 and capillary tube 12 may be filled with an appropriate inert gas, such as nitrogen at an appropriate pressure, say 300 torr. The fill pressure within the outer jacket affects the thermal characteristics of capillary tube 12 which during operation is cooled in part by conductive and convective flow within the outer jacket.

Base 16 includes a cylindrical portion 60 surrounding pinch seal 56 and a disk-shaped portion 62. Disk-shaped portion 62 includes a pair of apertures 64 through which lead wires 44 and 46 pass. A plurality of mounting holes 74 adapted to receive mounting screws (not shown) are formed around the periphery of disk-shaped portion 62. Base 16 is secured to the lower end of outer jacket 14 by means of an insulating cement 58 which is injected during manufacturing through at least one aperture 76 (see, FIG. 1) formed in cylindrical portion 60.

Figure 4:
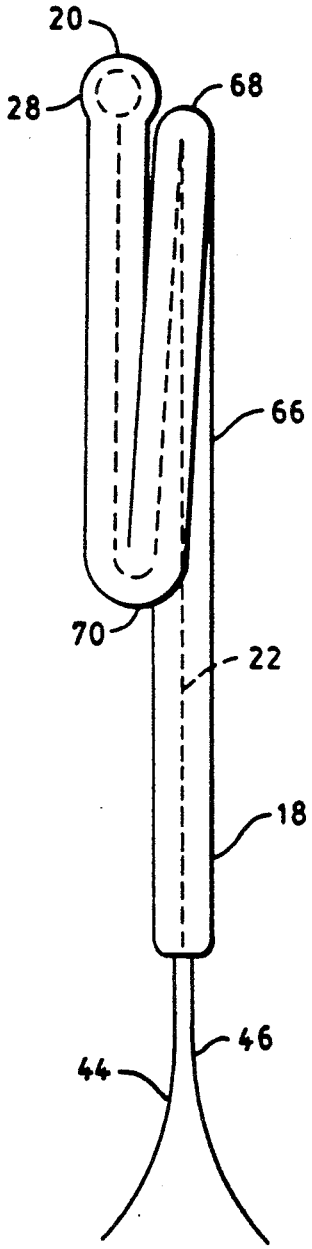
FIG. 4 is side elevation view of another embodiment of the light source.
Figure 5:
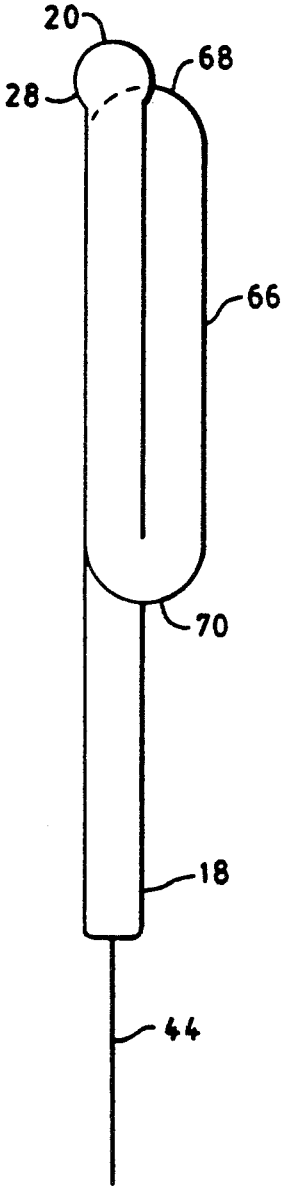
FIG. 5 is a side elevation view of the light source in FIG. 4 rotated 90 degrees.

It is well within the scope of the invention to construct the capillary tube with a convoluted shape other than that shown in FIGS. 1 and 2. In this regard, FIGS. 4 and 5 illustrate an alternative embodiment for the capillary tube. A capillary tube 66 is shown prior to sealing of the outer jacket. As shown therein, a double-bore capillary tube 66 contains a first U-shaped portion 68 and a second U-shaped portion 70. Preferably, the legs associated with each portion 68 and 70 are either in a contiguous relationship or closely adjacent with each other. If separated, the distance between legs is preferably less than 0.010 inch.

In the embodiment depicted in FIGS. 4 and 5, if the vertical distance between the tip of one of the electrodes (not shown) and the opposite end 20 of tube 66 is 1.5 inches (3.81 centimeters), the arc length will be approximately 9.0 inches (22.86 centimeters).

In a typical but non-limitative example of a miniature discharge lamp in accordance with the teachings of the present invention, the capillary tube is made from double-bore quartz glass having an outer diameter of about 4 millimeters and a diameter of about 2 millimeters. The capillary tube has a triple pass configuration similar to that depicted in FIGS. 4 and 5 and contains a 100% neon fill at a pressure of about 525 torr. The vertical distance measured from the tip of one of the electrodes to the remote end 20 of the capillary tube is approximately 1.5 inches (3.81 centimeters). As a result of this convoluted double-bore construction, the arc length is approximately 9.0 inches (22.86 centimeters).

A pair of electrodes is located at one end of the capillary tube. Each electrode consists of a 0.008 inch diameter tungsten rod welded to one end of a rectangular strip of molybdenum foil having a width of 0.030 inch, a length of 0.5 inch (12.7 millimeters) and a thickness of 0.0008 inch. A lead-in wire of molybdenum having a diameter of 0.020 inch is welded to the other end of each molybdenum strip. An outer jacket of glass consisting of borosilicate with lead (type 7720 Nonex) having an outer diameter of approximately 0.5 inch (12.7 millimeters) and a length of approximately 3.0 inches (7.62 centimeters) surrounds the capillary tube and contains nitrogen gas at a pressure of about 300 torr.

The above lamp was successfully operated with a DC power supply which is rated for input of 118 VAC, 50 to 500 HZ and output of 5 KV DC, 5 milliamps and a series resistance of 2 Megohms. The lamp operated at 1000 volts, 2 milliamps, and 2 watts to produce an intensity of 4.5 LPW. Due to the electrode construction and the relatively high pressure, the life of the lamp is expected to exceed 4000 hours.

At present, a typical lighted buoy may employ a 3 watt, 12 volt incandescent lamp rated at 500 hours and having an S-8 or S-11 clear bulb with a C-8 vertically-oriented incandescent filament. With a red filter, the 3 watt incandescent lamp produces 2 LPW.

The lamp of the present invention is ideally suited for use with the optics of a navigational signal such as a lighted buoy. The short arc tube length (i.e., vertical height) of the present invention provides efficient coupling with a small effective field stop such as in the conventional Fresnel drum lens optics of navigational buoys. For the same power, the arc discharge source has higher luminous efficacy than its filamented counterpart; conversely, for an equivalent observable range, the arc source requires less power. Because of the lower power requirement, the lamp may readily be energized from a solar source thereby reducing the cost of maintaining the buoy. As previously mentioned, the arc source of the lamp is more rugged and has longer life than its filamented counterpart. These latter features also contribute to reduced maintenance costs for the buoy.

There has thus been shown and described a miniature, low-wattage light source suitable for use in a navigational signal light, such as a lighted buoy wherein a red light is desired. The lamp has a relatively high efficiency and long life.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The actual scope of the invention is intended to be defined in the following claims when viewed in their proper perspective based on the prior art.

What is claimed is:

1. A light source comprising:

a double-bore capillary tube having a pair of ends and a convoluted shape, said capillary tube including a pair of U-shaped portions, each of said U-shaped portions having a pair of legs associated therewith, the legs of each pair being in a contiguous relationship or closely adjacent to each other;

a pair of electrodes located at one end of said capillary tube and disposed within the respective bores; and an ionizable medium enclosed within said capillary tube and consisting of neon at a pressure within a range of from about 300 to 600 torr.

2. The light source of claim 1 wherein each leg of said pair is separated a distance not greater than 0.010 inch.

* * * * *